US010308467B2

(12) United States Patent
Kuth

(10) Patent No.: US 10,308,467 B2
(45) Date of Patent: Jun. 4, 2019

(54) DEVICE FOR UNROLLING AND CUTTING A STRIP

(71) Applicant: Rudolf Kuth, Freiburg (DE)

(72) Inventor: Rudolf Kuth, Freiburg (DE)

( * ) Notice: Subject to any disclaimer, the term of this patent is extended or adjusted under 35 U.S.C. 154(b) by 0 days.

(21) Appl. No.: 15/544,948

(22) PCT Filed: Jan. 12, 2016

(86) PCT No.: PCT/DE2016/000011

§ 371 (c)(1),
(2) Date: Jul. 20, 2017

(87) PCT Pub. No.: WO2016/124167

PCT Pub. Date: Aug. 11, 2016

(65) Prior Publication Data

US 2017/0355549 A1 Dec. 14, 2017

(30) Foreign Application Priority Data

Feb. 4, 2015 (DE) ..... 10 2015 001 402

(51) Int. Cl.
*B65H 35/00* (2006.01)

(52) U.S. Cl.
CPC ..... *B65H 35/0026* (2013.01)

(58) Field of Classification Search
CPC ..... B65H 35/0026; B65H 35/0006; B65H 35/06; B65H 35/0033; B65H 35/0073; Y10T 156/1348; Y10T 156/1052; Y10T 225/10; Y10T 156/1795; Y10T 156/12; Y10T 225/26; Y10T 225/268; Y10T 225/297; Y10T 225/257
USPC ..... 225/56, 65, 90, 25, 26, 57, 60, 61, 66, 225/77, 82, 88, 91, 71, 67, 69, 656, 6, 39; 156/250, 510, 577, 574; D19/67, 69
See application file for complete search history.

(56) References Cited

U.S. PATENT DOCUMENTS 2,609,877 A * 9/1952 Hanington ..... B65H 35/008 225/25
3,450,318 A * 6/1969 Turner ..... B65H 35/008 225/65
3,623,643 A * 11/1971 Ikeda ..... B65H 35/0026 225/65

(Continued)

FOREIGN PATENT DOCUMENTS

DE 10 2010 007 002 8/2011
JP S59 88060 6/1984

(Continued)

*Primary Examiner* — Ghassem Alie
(74) *Attorney, Agent, or Firm* — Gudrun E. Huckett

(57) ABSTRACT

The problem addressed by the invention is that of ensuring simple handling in the case of a device for unrolling and cutting off a strip (2) on a strip roll (3), said device having a main body (4), wherein the main body (4) has: a top side (5), having a tear-off blade (9), a gap (12), a storage plate (13) for storing the strip (2), and a roller (22); two lateral guiding surfaces (6, 7); and an underside (8). This problem is solved in that the storage plate (13) can be lateral pivoted or the roller (22) arranged after the gap (12) as viewed against the unrolling direction (11) can be inserted and locked in order to store the strip (2), wherein the storage plate (13) or the roller (22) forms the gap (12) in the end position thereof together with a rear edge (14) of the top side (5).

9 Claims, 3 Drawing Sheets

(56) References Cited

U.S. PATENT DOCUMENTS

| | | | | |
|---|---|---|---|---|
| 5,634,580 | A * | 6/1997 | Levy | B65H 35/008 225/56 |
| 7,841,498 | B1 | 11/2010 | Rohrer | |
| 8,443,862 | B1 * | 5/2013 | Manabat | B65H 35/0026 156/527 |
| 2013/0087275 | A1 | 4/2013 | Johnson et al. | |

FOREIGN PATENT DOCUMENTS

| | | |
|---|---|---|
| JP | H01 308359 | 12/1989 |
| JP | H11 147660 | 6/1999 |

* cited by examiner

DEVICE FOR UNROLLING AND CUTTING A STRIP

BACKGROUND OF THE INVENTION

The invention concerns a device for unrolling and cutting a strip on a strip roll, wherein the device is provided with a base member, wherein the base member comprises a topside with a tear-off blade, a slot, a storage plate for storing the strip, and a roller, two lateral guide surfaces, and a bottom side. The strips employed in the context of this invention can be adhesive tapes, packaging and securing tapes and strips with and without adhesive coating, such as self-adhesive fixation strips in the medical field.

Such a device is disclosed in US 2013/0 087 275 A1. In this device, behind the slot the tear-off blade and downstream thereof an upwardly pivotable storage plate are arranged. In front of the slot, a roller is provided for holding down the strip.

A further device is disclosed in DE 10 2010 007 002 A1. The described strip cutter can be placed on top of the strip roll as well as laterally pushed onto the strip roll. In use, a loose end of the strip is lifted off the outer circumference of the strip roll and is guided through the slot of the base member. In a further embodiment, the strip can also be inserted from the side into the slot. It is disadvantageous that passing the strip through the slot is rather cumbersome and that the device as a whole is also not sufficiently secured on the strip roll.

It is thus the object of the invention to further develop a device of the aforementioned kind in such a way that simple handling is ensured. In addition, the device should be secured on the strip roll during use.

SUMMARY OF THE INVENTION

As a solution to this object, it is proposed according to the invention to configure the device of the aforementioned kind in such a way that the storage plate is laterally pivotable or the roller, arranged behind the slot when viewed against the unrolling direction, for storing the strip is insertable and lockable, wherein the storage plate or the roller in its end position forms the slot together with a rear edge of the topside.

When using the device according to the invention, it is first mounted on or pushed onto the strip roll, with storage plate folded upward or without roller. Subsequently, the free end of the strip is lifted up from the outer circumference of the strip roll and the storage plate folded down or the roller inserted. In its end position, the storage plate or the roller form the slot together with the rear edge of the topside. In this way, the device according to the invention is now ready for use. A cumbersome guiding through or threading of the strip into the slot, as in the prior art, is thus not needed. Since the base member has approximately the shape of a quadrangular frame, the device is also secured sufficiently on the strip roll.

In order to avoid accidental upward pivoting of the storage plate in operation of the device, one embodiment of the invention provides that the storage plate in its end position locks with a lateral guide surface. When the device after use is to be removed again from the strip roll, the locking action is released and the storage plate is pivoted upwardly. In this way, the free end of the strip can be placed again onto the outer circumference of the strip roll. Subsequently, the device is lifted off the strip roll. In order to enable insertion of the device on the strip roll, the base member is not completely closed but a passage opening for the strip roll into the base member must remain free. Advantageously, one of the lateral guide surfaces is therefore partially open in direction toward the center of the roll and does not extend completely to the bottom side of the base member.

In order to ensure safe guiding of the device on the strip roll even for decreasing diameter of the strip roll due to use of the strip, a further embodiment of the invention provides that the bottom side of the base member is comprised of an elastic clamping bracket which is resting against the inner side of the strip roll. The pretension of the clamping bracket and also the contact surface of the clamping bracket on the inner side of the strip roll, depending on the thickness of the strip roll, can be embodied differently. For a range of use as broad as possible, the clamping bracket is advantageously S-shaped and spoon-like.

When tearing off the strip at the tear-off blade, it is conceivable that the device can move uncontrolled on the outer circumference of the strip roll. In order to prevent this, a further embodiment of the invention provides that on the topside of the base member a stop that is interacting with the strip is provided. As soon as the strip is placed and pushed onto the tear-off blade, the stop is pushed onto the outer circumference of the strip and prevents thus a further movement of the device. In order for this braking action to be optimal, a further embodiment of the invention provides that the stop is arranged in the area of the tear-off blade.

As the strip is pulled off, the device according to the invention glides along the outer circumference of the strip roll. The movement of the device relative to the strip roll is effected by pulling off the strip because the strip, in particular with its face that is not adhesive, is contacting the rear edge of the topside and therefore displaces the topside in the unrolling direction due to a force component.

BRIEF DESCRIPTION OF THE DRAWINGS

The invention will be explained in more detail in the following with the aid of the drawing. The drawing shows embodiments of the invention. In this context, it is shown in.

DESCRIPTION OF PREFERRED EMBODIMENTS

Figure 1:
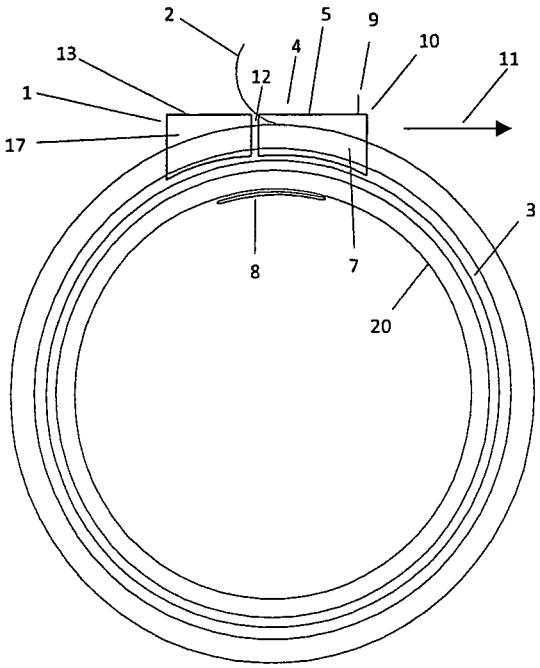
FIG. 1 a side view of a first embodiment with strip roll.
Figure 2:
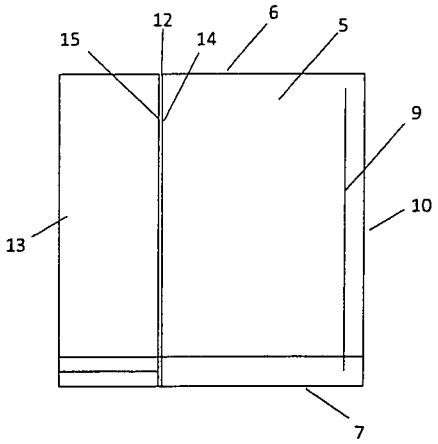
FIG. 2 a plan view according to FIG. 1 without strip roll.

The device 1 for unrolling and cutting a strip 2 on a strip roll 3 comprises a base member 4. The base member 4 comprises a topside 5, a first lateral guide surface 6, a second lateral guide surface 7, and a bottom side 8. The base member is embodied monolithic. On the topside 5, a tear-off blade 9 which is extending in radial direction outwardly is arranged so as to be positioned close to a forward edge 10 of the topside 5. The tear-off blade 9 has the shape of a saw and extends at a slant, wherein one side is taller than the other side in order to facilitate cutting off the strip 2. The front edge 10 faces in the direction of an unrolling direction 11 of the base member 4. At the topside 5, a slot 12 is formed. The topside 5 comprises furthermore a storage plate 13. The slot 12 is located between a rear edge 14 of the part of the topside 5 on which the tear-off blade 9 is arranged and a front edge 15 of the storage plate 13. The storage plate 13 is pivotable about a pivot area 16 in upward direction, i.e., in radial direction. The pivot area 16 is located at the upper edge of the first guide surface 6. On the other side, the storage plate 13 has a projection 17 which is extending parallel to the second guide surface 7 and is lockable with the second guide surface 7. For this purpose, the projection 17 has an inwardly oriented protrusion 18 which in the end position of the storage plate 13 engages about the second guide surface 7. The protrusion 18 engages only that part of the second guide surface 7 which is positioned close to the projection 17. When viewed in a side view, the protrusion 18 has a tapering pointed shape with a top edge that is not extending horizontally but at a slant. Accordingly, the adjoining bottom edge of the second guide surface 7 also extends at a slant in order to avoid that the protrusion 18 and the second guide surface 7 slide apart after locking. The bottom side 8 is an elastic clamping bracket which is connected with the first guide surface 6 and which extends from the first guide surface 6 toward the second guide surface 7. The bottom side 8 in longitudinal section is S-shaped and comprises, approximately after ⅔ when viewed from the first guide surface 6, a bending area 19 which upon use of the device 1 is contacting an inner side 20 of the strip roll 3. Since the clamping bracket is elastic, this bending area 19 is still contacting the strip roll 3 even when the latter, due to continuous use, has reduced its diameter.

Figure 3:
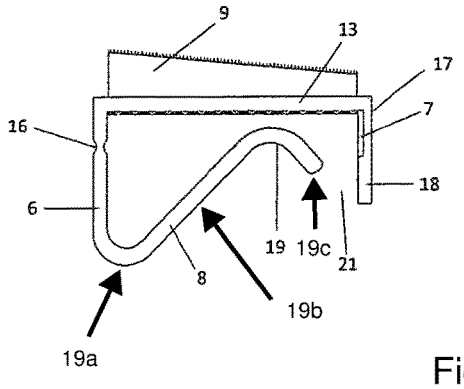
FIG. 3 a rear view according to FIG. 2.
Figure 4:
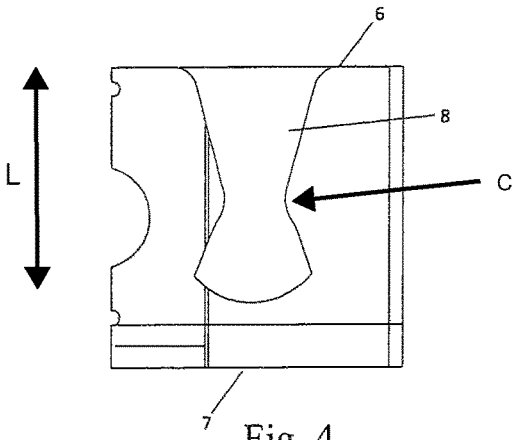
FIG. 4 a view from below according to FIG. 2.

The S-shaped elastic clamping bracket of the bottom side 8 is comprised of the bending area 19, the bending area 19*a*, and the straight section 19*b* between the two bending areas 19, 19*a*, and ends at free end 19*c*. FIG. 4 shows the bottom side 8 in a view from below. The bottom side 8 in the form of the elastic clamping bracket is embodied spoon-like with a constriction C in a direction of length L of the clamping bracket (FIG. 3). As can be seen in FIG. 3, the second guide surface 7 does not extend as far downward in the direction of the center of the strip roll 3 as the first guide surface 6. Accordingly, a through opening 21 between the bottom side 8 and the second guide surface 7 is formed through which the strip roll 3 can be passed through when the device 1 is pushed onto the strip roll 3.

When using the device 1, the second guide surface 7 is placed onto the outer circumference of the strip roll 3 and the elastic bottom side 8 is somewhat bent open toward the center of the strip roll 3. Then the strip roll 3 can be pushed through the through opening 21 and is located then within the base member 4 wherein the bottom side 8 is contacting the inner side 20 of the strip roll 3. The storage plate 13 is then folded open and the free end of the strip 2 is lifted up as can be seen in FIG. 1. Now the storage plate 13 is folded down again and locks at the second guide surface 7. The storage plate 13 is now in one plane with the remaining topside 5 and forms thus the slot 12 in which the strip 2 is extending. In this way, simple handling for insertion of the strip 2 into the slot 12 is provided. Prior to further use, the strip 2 can now be placed on or adhered to the storage plate 13. By further pulling up the strip 2 which is contacting with its non-adhesive surface the rear edge 14, the base member 4 is pushed in the unrolling direction 11. When the desired length of the strip 2 has been dispensed, the strip 2 is pivoted downwardly onto the tear-off blade 9 and torn off. The strip 2 can of course also be adhered to the desired location after having been pulled up initially and, by pulling away the strip roll 3, the base member 4 is then also displaced in the unrolling direction 11 and the strip 2 dispensed. Without particular differences in handling, the device 1 can be placed and used on the roll in both directions. The direction in which the storage plate 13 is pointing to the open end of the strip 2 enables better storage of the strip end. Upon pulling out the strip 2, the strip roll 3 must not be held rigidly and fixedly. It is guided movably through the slightly closed hand, between the thumb on one side and the fingers on the other side, so that it can rotate by sliding in the hand and thereby can unroll.

Figure 5:
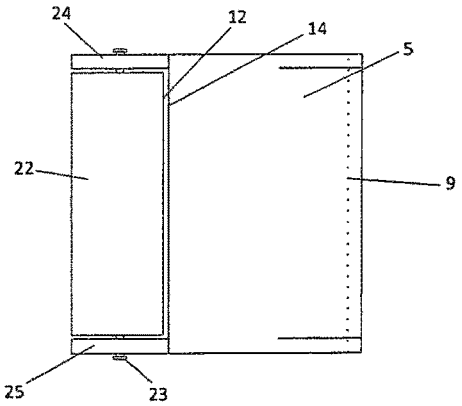
FIG. 5 a plan view of a further embodiment.
Figure 6:
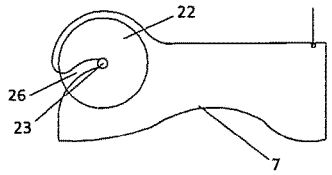
FIG. 6 a side view according to FIG. 5.

In the embodiment illustrated in FIG. 5, a roller 22 is provided in place of the storage plate 13. The roller 22 is seated in a U-shaped cutout of the topside 5 that is open at one side. The axis 23 of the roller 22 is locked at a first lateral clamping holder 24 and a second lateral clamping holder 25. The two lateral clamping holders 24, 25 extend approximately from the rear edge 14 in upward direction. Each lateral clamping holder 24, 25 has a guide slot 26 for insertion of the axis 23 of the roller 22 so that the roller 22 can be inserted. In its end position, the roller 22 again forms, together with the rear edge 14, the slot 12 for the strip 2. In use of this embodiment, the device 1 without inserted roller 22 is pushed onto the strip roll 3. Then the strip 2, as also in the first embodiment, is lifted up and pulled in upward direction. Subsequently, the roller 22 is inserted and forms then with its outer circumference the slot 12 and thus the guide means for the strip 2. The strip 2 can now be placed on or adhered to the roller 22 prior to further use.

On the inner surface of the topside 5, a stop is arranged facing the strip 2 and positioned close to the front edge 10 of the topside 5. When tearing off the strip 2 at the tear-off blade 9, due the pressure on the tear-off blade 9 the topside 5 is pushed in downward direction toward the strip 2 and thus the stop is forced also onto the strip 2. In this way, a further movement of the base member 4 in the unrolling direction 11 is avoided when tearing off the strip 2.

Figure 7:
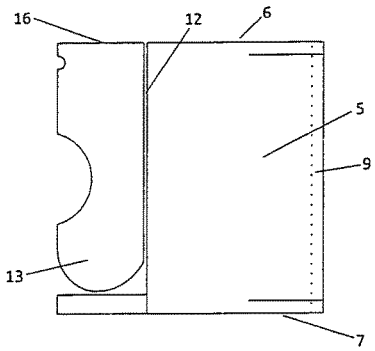
FIG. 7 a plan view of a further embodiment.

In the embodiment according to FIG. 7, the storage plate 13 extends approximately up to the second guide surface 7 and has no projection. In this way, it cannot be locked with the second guide surface 7. The storage plate 13 is however also pivotable here and the insertion of the strip 2 is realized as described above in the first embodiment, wherein it is conceivable here that the strip 2 is inserted somewhat more from the side.

Figure 8:
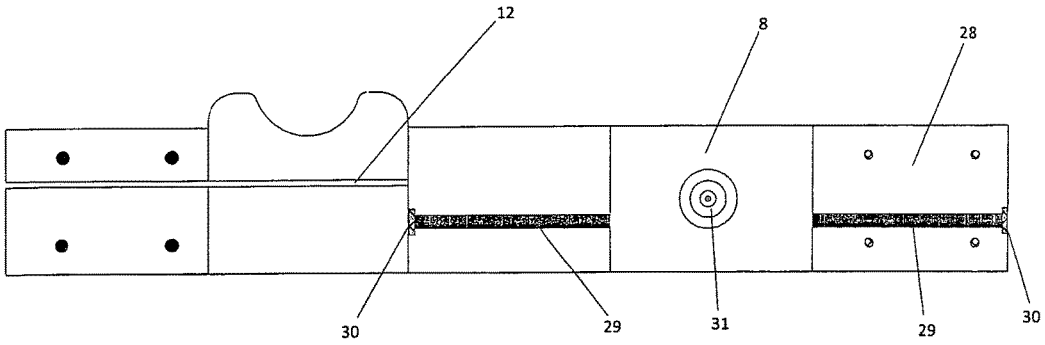
FIG. 8 a view of a further embodiment, folded open.

The embodiment illustrated in FIG. 8 with folding brackets 28 is constructed for strip rolls 3 in which the inner diameter is very small, the outer diameter however very large and for which therefore the lateral surfaces are very wide. In use, the device 1 encloses the entire strip roll 3 wherein the basic frame and the folding brackets 28 overlap at one of the two lateral surfaces of the roll. They are fastened and secured on each other by snap fasteners. The frame of this embodiment is U-shaped toward the center of the roll with two right angles at the edges, and is closed and rigid. On the inner side of the lateral guide surfaces 6, 7, a vertical or radially extending guide rail 29 is located, respectively. By means of the latter, a pressure plate is guided and is limited in its movement by transverse projections 30 at the ends of the guide rails 29. The pressure plate has at its short sides a groove corresponding to the guide rails 29. The pressure plate is pushed outwardly by a spring 31 which with its base is seated on the bottom side 8, i.e., inwardly at the frame bottom, on a base plate. The base plate can exert by means of an adjusting screw a stronger pressure on the spring 31. The thread which is required for this is located in the bottom of the frame. This device 1 is pushed from the roll center onto the strip roll 3 wherein the pressure plate is guided against the inner side 20 of the strip roll 3 and the spring 31 securing it is compressed. After having been pushed on sufficiently far on the strip roll 3, the folding bracket 28 which secures the tear-off blade 9 is folded about the outer surface of the roll and locked by the snap fasteners. Now the strip 2 to be used is lifted off the strip roll 3 and held across the already closed bracket. The folding bracket that is still open at this point is now also folded closed and secured by the snap fasteners.

What is claimed is:

1. A device for unrolling and cutting a strip on a strip roll, the device comprising:

a base member comprising a topside provided with a rear edge, a first lateral guide surface and a second lateral guide surface attached opposite each other to opposed sides of the topside and extending downwardly away from the topside, and a bottom side comprised of an elastic clamping bracket connected to an end of the first lateral guide surface located opposite the topside;

a tear-off blade arranged on the topside;

a storage plate for storing a free end of the strip by adhering an adhesive surface of the free end to the storage plate;

wherein the storage plate is positioned in an end position on the base member such that a slot is formed between the rear edge of the topside and the storage plate for passing the strip through from below the topside atop of the topside;

wherein the storage plate is laterally pivotable away from the rear edge of the topside;

wherein the elastic clamping bracket comprises a direction of length and extends in the direction of length from the first lateral guide surface toward the second lateral guide surface, wherein between an end of the elastic clamping bracket facing the second lateral guide surface and the second lateral guide surface a through opening is provided.

2. The device according to claim 1, wherein the storage plate in the end position is configured to lock with one of the two lateral guide surfaces.

3. The device according to claim 1, wherein the elastic clamping bracket is configured to contact an inner side of the strip roll when the strip roll is inserted into the device.

4. The device according to claim 3, wherein the clamping bracket comprises a first bending area connected to the end of the first lateral guide surface, a straight section comprising a first end connected to the first bending area, and a second bending area connected to a second end of the straight section and curved opposite to the first bending area so that the clamping bracket is S-shaped.

5. The device according to claim 3, wherein the clamping bracket comprises a constriction in the direction of length.

6. The device according to claim 1, wherein the strip is insertable into the slot from an outer circumference of the strip roll.

7. The device according to claim 1, wherein pulling the strip in a radial direction relative to the strip roll, when the strip roll is inserted in the device, effects a forward movement of the base member in an unrolling direction of the strip from the strip roll.

8. The device according to claim 1, wherein the storage plate is disposed at the topside, wherein the slot is located between the rear edge of the topside and a front edge of the storage plate facing the rear edge.

9. The device according to claim 1, wherein the storage plate is in one plane with the topside in the end position of the storage plate.

* * * * *